US009121208B2

(12) United States Patent
Nur-tegin

(10) Patent No.: US 9,121,208 B2
(45) Date of Patent: Sep. 1, 2015

(54) UNCLIMBABLE CHILD BARRIER

(71) Applicant: Kanybek Dosbolovich Nur-tegin, Palm Beach Gardens, FL (US)

(72) Inventor: Kanybek Dosbolovich Nur-tegin, Palm Beach Gardens, FL (US)

( * ) Notice: Subject to any disclaimer, the term of this patent is extended or adjusted under 35 U.S.C. 154(b) by 0 days.

(21) Appl. No.: 13/768,055

(22) Filed: Feb. 15, 2013

(65) Prior Publication Data

US 2013/0227888 A1 Sep. 5, 2013

Related U.S. Application Data

(60) Provisional application No. 61/606,527, filed on Mar. 5, 2012, provisional application No. 61/642,534, filed on May 4, 2012.

(51) Int. Cl.

| | |
|---|---|
| ***E05D 15/02*** | (2006.01) |
| ***E06B 9/00*** | (2006.01) |
| *E04H 17/00* | (2006.01) |

(52) U.S. Cl.

CPC . *E05D 15/02* (2013.01); *E06B 9/00* (2013.01); *E04H 17/003* (2013.01); *E06B 2009/002* (2013.01)

(58) Field of Classification Search

USPC ..... 49/50, 61–63, 504, 505; 74/575, 577 M; 119/705, 702, 712, 446, 473

See application file for complete search history.

(56) References Cited

U.S. PATENT DOCUMENTS

| | | | | | |
|---|---|---|---|---|---|
| 321,171 | A | * | 6/1885 | Archibald | 256/12 |
| 435,708 | A | * | 9/1890 | Poole | 256/12 |
| 504,936 | A | * | 9/1893 | Niles | 256/12 |
| 511,700 | A | * | 12/1893 | Jacobs | 256/12 |
| 1,175,109 | A | * | 3/1916 | Anderson | 160/372 |
| 1,325,519 | A | * | 12/1919 | Jenkins | 38/102.1 |
| 2,357,819 | A | * | 9/1944 | Greer | 160/351 |
| 3,068,937 | A | * | 12/1962 | Christensen | 160/41 |
| 3,403,412 | A | * | 10/1968 | Gottfried et al. | 5/100 |
| 4,321,770 | A | * | 3/1982 | Mullins, Jr. | 49/50 |
| 4,329,076 | A | * | 5/1982 | Coreth | 403/109.8 |
| 4,679,351 | A | * | 7/1987 | Zarlengo et al. | 49/57 |
| 4,685,247 | A | * | 8/1987 | Alam | 49/55 |
| 4,787,174 | A | | 11/1988 | Brown | |
| 5,293,721 | A | * | 3/1994 | Richard et al. | 52/101 |
| 5,531,258 | A | * | 7/1996 | Poulson et al. | 160/376 |
| 5,551,726 | A | * | 9/1996 | Ament | 280/749 |
| 5,575,113 | A | * | 11/1996 | Huang | 49/55 |
| 5,684,274 | A | * | 11/1997 | McLeod | 174/92 |
| 5,690,317 | A | * | 11/1997 | Sandsborg | 256/1 |
| 5,704,164 | A | * | 1/1998 | Huang | 49/55 |
| 5,797,218 | A | * | 8/1998 | Holland | 49/55 |
| 6,056,038 | A | * | 5/2000 | Foster et al. | 160/351 |
| 6,102,375 | A | * | 8/2000 | Colless et al. | 256/26 |

(Continued)

FOREIGN PATENT DOCUMENTS

| | | | | | |
|---|---|---|---|---|---|
| CN | 201678965 | | * | 12/2010 | E01F 15/06 |
| JP | 2005016270 | A | * | 1/2005 | E04F 11/18 |
| WO | WO 9111226 | A1 | * | 8/1991 | A63B 29/00 |

*Primary Examiner* — Katherine Mitchell

*Assistant Examiner* — Shiref Mekhaeil

(57) ABSTRACT

A child safety barrier is to be positioned across a passageway such as a doorway, stair landing or corridor, play pen or crib. The barrier includes an elongated member that is supported generally horizontally. The barrier is supported for rotation preferably in a direction that limits the ability of the child to pass over the barrier. Various alternative elongated members are described and various alternative support systems for the elongated members are described.

18 Claims, 19 Drawing Sheets

(56) References Cited

U.S. PATENT DOCUMENTS

| | | | | |
|---|---|---|---|---|
| 6,233,877 | B1 * | 5/2001 | Monroe | 52/37 |
| 6,296,041 | B1 * | 10/2001 | Cicero | 160/327 |
| 6,336,542 | B1 * | 1/2002 | Mintonye, II | 193/37 |
| 6,370,823 | B1 | 4/2002 | Andersen | |
| 6,375,165 | B1 * | 4/2002 | Sherratt et al. | 256/24 |
| 6,474,021 | B2 * | 11/2002 | Homeyer | 49/57 |
| 6,497,268 | B1 * | 12/2002 | Peppett | 160/374.1 |
| 6,536,502 | B2 * | 3/2003 | Britto et al. | 160/23.1 |
| 6,575,435 | B1 * | 6/2003 | Kotzen | 256/24 |
| 6,585,233 | B1 * | 7/2003 | Sorben | 256/12 |
| 6,598,921 | B2 * | 7/2003 | Seel et al. | 296/24.43 |
| 6,655,087 | B2 | 12/2003 | Andersen | |
| 6,988,525 | B2 * | 1/2006 | Moulton | 160/52 |
| 7,065,922 | B1 * | 6/2006 | De Kruijf et al. | 49/57 |
| 7,107,635 | B2 * | 9/2006 | Henry et al. | 5/424 |
| 7,178,792 | B2 | 2/2007 | Monahan | |
| 8,191,604 | B2 * | 6/2012 | Wang | 160/296 |
| 8,261,490 | B2 * | 9/2012 | Flannery et al. | 49/55 |
| 8,572,775 | B1 * | 11/2013 | Biter et al. | 5/100 |
| 2007/0173749 | A1 * | 7/2007 | Williams et al. | 601/123 |
| 2008/0000730 | A1 * | 1/2008 | Port-Robach et al. | 188/71.2 |
| 2009/0211023 | A1 * | 8/2009 | Cocco et al. | 5/424 |
| 2009/0211716 | A1 * | 8/2009 | Fitzpatrick | 160/327 |
| 2010/0229802 | A1 * | 9/2010 | Bok | 119/416 |

* cited by examiner

UNCLIMBABLE CHILD BARRIER

CROSS-REFERENCE TO RELATED APPLICATIONS

This application is based on U.S. Provisional Application No. 61/606,527 filed Mar. 5, 2012, and U.S. Provisional Application No. 61/642,534 filed May 4, 2012, the entirety of each of which is hereby incorporated by reference.

BACKGROUND

Small children have a natural tendency to climb and explore and do not wish to be restrained in a room or in a crib or playpen. The tendency to climb, of course, creates a number of hazards. Efforts have been made in the past to restrain children such as by the use of products referred to as safety gates.

The problem arises in various environments such as trying to keep children within a room (or excluded from a room, such as a kitchen where hazards exist) or within a play area (such as a crib or playpen or other enclosure) where a climbing child is at risk of falling or at risk of going into an unsafe area after exiting the play area.

The identification of the problems and the proposed solutions will be given in the context of keeping a child on one side of a barrier and/or keeping a child restrained within a play or sleep area, it being understood, however, that these are all exemplary and non-limiting.

Passageway barriers, also called child or baby safety gates, are designed to serve as temporary means of closing off access to potentially dangerous or otherwise restricted areas of a house or other domicile or place of business to prevent children or animals from passing beyond the barrier.

There are a great variety of such partitioning barriers available on the market today. Passageway barriers are made of rigid materials, such as wood, molded plastic or metal or a combination thereof. Some of these rigid barriers are stationary and require an adult who wishes to pass through the passageway to either step over the barrier or find a way around the barrier. Examples of such barriers are illustrated in U.S. Pat. No. 4,787,174, issued to Tyrone Brown on Nov. 19, 1988, and U.S. Pat. No. 6,655,087, issued to Jesper Andersen on Dec. 2, 2003. Other rigid-material barriers include a gate, which can be swung open to provide easier passage for adults. Examples of this type of barriers are U.S. Pat. No. 4,685,247, issued to Aftab Alam on Aug. 11, 1987, and U.S. Pat. No. 6,370,823 B1, issued to Finn Andersen on Apr. 16, 2002.

Rigid child safety barriers and/or passageway barriers, however, suffer a number of significant shortcomings. First, they can be large and cumbersome, which lessens their portability. In addition, toddlers or young children may be able to climb many barriers of this type, especially if their barrier panels are comprised of a grid of rigid members or a gridiron of molded plastic. The hazards of climbing these gates by young children are obvious and include the risk of falling as well as children having their fingers or toes getting caught in the grid of barrier panels. Also, repeated attempts to climb the gate can loosen the gate's positioning in its place, thereby reducing its reliability in preventing passage and increasing the risk of injury. This is especially likely for friction-mounted gates, e.g. those that are not permanently fastened to the sides of the passageway with screws or nails but rather held in place by spring-loaded devices. Furthermore, nearly all child safety gates are too tall for most adults to step over. The height of safety gates can significantly raise the risk of injury particularly when the adult tries to step over the gate while carrying a child. Child safety barriers with openable gates are designed to overcome the problem of allowing access by the adult (i.e., authorized access). However, these openable gates require at least one free hand—a significant inconvenience for a person attending to a child—and the latches tend to be too stiff and difficult to operate.

Another common type of passageway barrier makes use of a flexible partitioning screen or membrane that can be releasably extended between the two sides of a passageway. Examples of these types of barriers are illustrated in U.S. Pat. No. 6,375,165 B1, issued to Richard Sherratt, et al on Apr. 23, 2002, and U.S. Pat. No. 7,178,792 B2, issued to Robert Monahan et al. on Feb. 20, 2007. While these barriers pose greater difficulties for the climbing child, it should be appreciated that some children are able to grab the top edge of the partitioning screen and pull themselves up high enough to swing a foot over the top edge for additional leverage and overcome the barrier. This again creates a serious health hazard to the child from falling off the top of the barrier. For the adult, passing through the passageway blocked by a flexible membrane child safety barrier may not be any easier than when a rigid barrier is installed within the passageway. This is because flexible barriers also require at least one free hand to open and close the screen. In fact, some flexible barriers may require two-handed operation. In addition, this type of barrier also cannot be easily and safely stepped over because this type is usually as tall as the rigid type barriers.

Similar problems are encountered with conventional cribs, playpens and play yards. More specifically, most cribs and bounded play areas for small children are designed to ensure that infants and toddlers are unable to climb out. In the case of cribs, for example, this often means that they are made sufficiently deep as judged by crib manufacturers. While a greater crib depth may reduce the likelihood of a child climbing out, it comes at a cost of significant inconvenience for parents and makes the possible fall more dangerous for children who manage to overcome a taller crib side. Laying a sleeping child into a deep crib often presents a nontrivial physical challenge, as the parent must lean all the way into the bottom of the crib while holding the child in both arms and trying not to wake the child. Until recently some cribs had drop sides, slide-down sides or drop gates designed to address this major inconvenience. However, most such crib designs are no longer considered safe following the changes in crib safety standards in June 2011. In addition, it has been observed that despite the considerable crib depth, some small children are capable of climbing out of the crib as long as they can reach the rim of the crib. Thus, the need for a more effective child safety barrier for keeping children safe within their cribs, playpens, and other play areas is apparent.

SUMMARY

For ease of description, the term "barrier" will be used whenever feasible to refer to both child safety barriers of the type which may be placed in a passageway and the type which may be placed on a crib, play area, etc. Exceptions to the foregoing general statement, if any, will be apparent based on the context in which the term "barrier" is used.

Barriers as described below, installed in a passageway or a crib, provide an effective way of preventing small children from entering or leaving a restricted area of a house or climbing out of a crib or other sleeping area. Unlike other child safety barriers that can be easily climbed by a child, the barriers as described below include a rotating portion (or portions) which functions to deny the child climbing leverage even when the barrier is placed relatively low, i.e., close to the floor or the bottom of a crib. This is an important safety advantage because it significantly reduces the possibility of the child falling. The barriers described below provide excellent stability—a feature not typically present in friction-mounted barriers.

Furthermore, in order to be effective in blocking off household areas most prior art passageway barriers are too tall for most adults to easily step over them. Because the rotating feature of the barrier described below makes it very difficult for children to climb over, the barrier described below can be installed at a lower vertical level thus allowing significantly greater freedom of movement for attending adults.

Yet another feature of the barrier described below, when installed on a crib, play pen, play area, etc., provides more safety for infants and toddlers while providing more convenience for the adults attending to the infants and toddlers. On the one hand, the rotating portion of the barrier denies the child climbing leverage while, on the other hand, the barrier may be placed vertically lower (or the mattress of the crib vertically higher) thus making it easier for the adult to place the child in the crib, play pen or the like.

The various embodiments of the barrier described below include at least one rotating portion that allows rotation in one direction only and is mounted such that the rotation occurs "inwardly" in the direction of the area where the child is to be restrained.

BRIEF DESCRIPTION OF THE DRAWINGS

The various objects and advantages of the unclimbable barrier will become more apparent upon reading the following detailed description taken in conjunction with the accompanying drawings.

In the drawings, wherein like reference numerals identify corresponding parts.

DETAILED DESCRIPTION

The following are non-limiting examples of a child safety barrier with a rotating portion.

Figure 1:
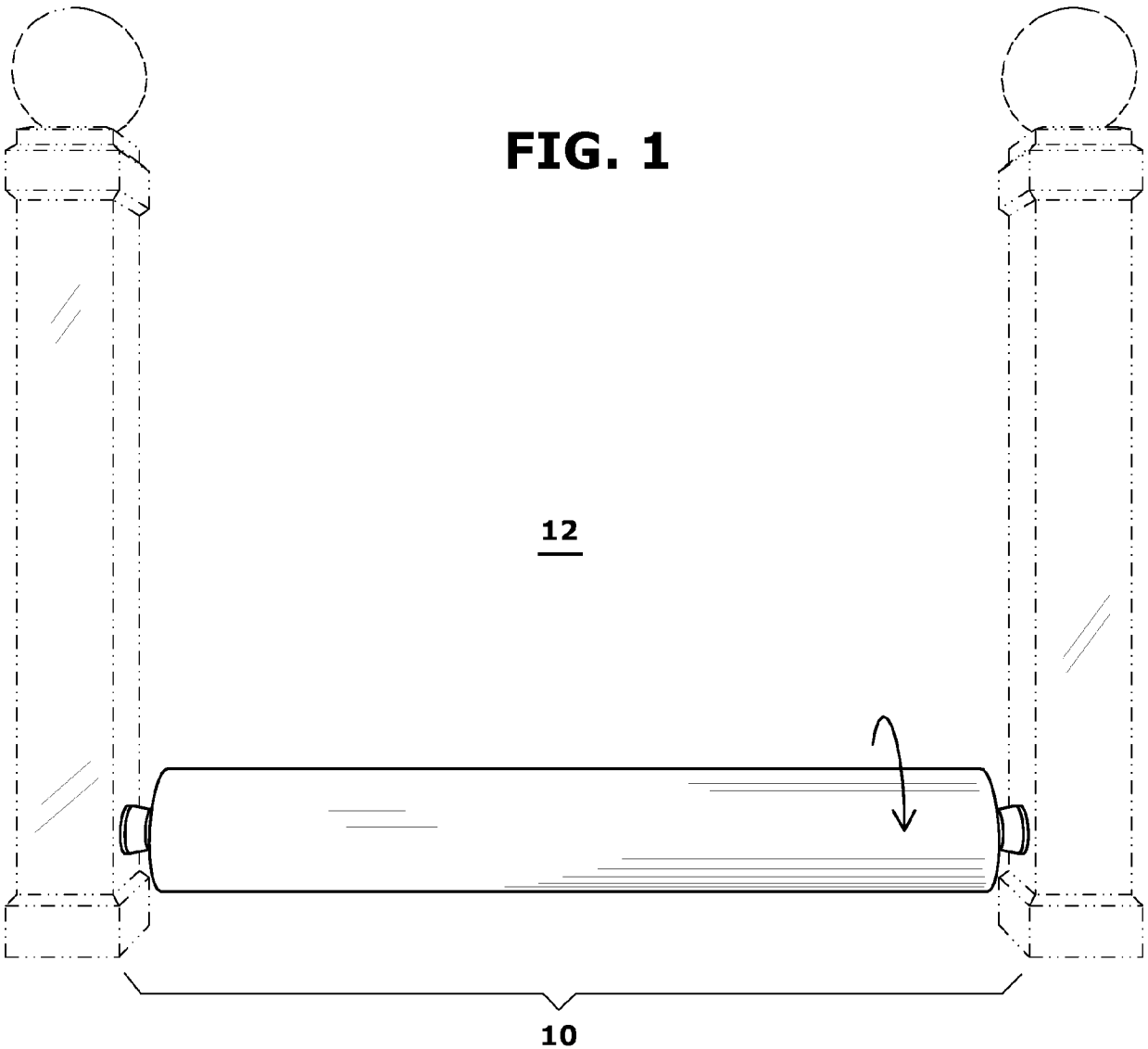
FIG. 1 is a front elevation view of a child safety barrier mounted in a passageway in accordance with one embodiment.

Referring first to FIG. 1, a child safety barrier 10 having a rotating portion is positioned between two generally vertical members with a passageway 12 generally identified as the area between the vertical members. One typical location for a child safety barrier is between the vertical jambs of an open doorway.

Figure 3A:
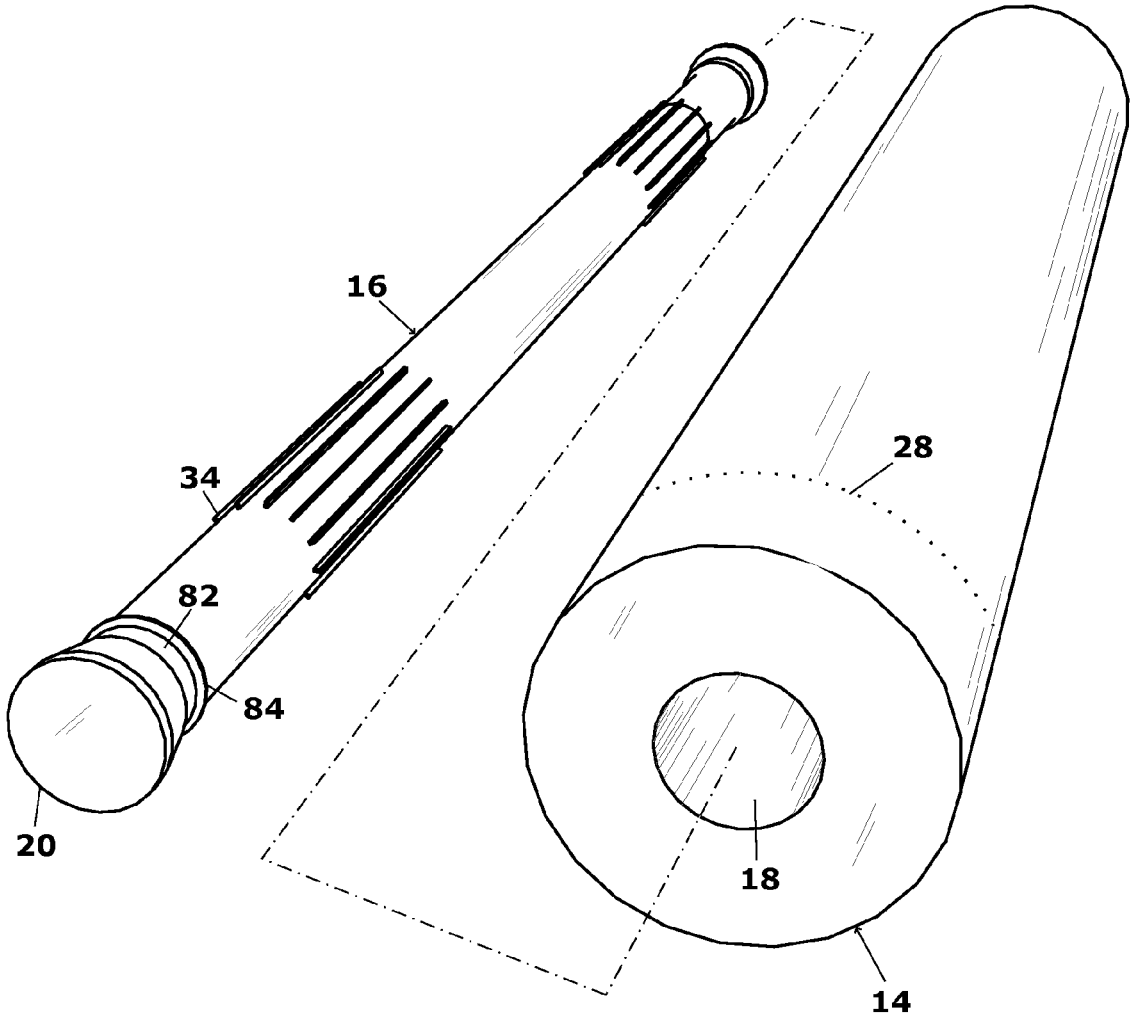
FIG. 3A is an exploded perspective view of a rotating portion of the child safety barrier.

Referring to FIG. 3A, the child safety barrier having a rotating member is illustrated in an exploded perspective view. A first elongated member 14 has a hollow core or lumen 18 adapted to receive an elongated support rod, arbor or shaft 16. In FIG. 1 the direction of rotation of the barrier 10 is illustrated by the arrow as rotating toward a person viewing the Figure. Thus despite the low placement of the barrier relative to the floor, the barrier is effective in restricting the movement of a small child attempting to climb through the passageway 12 by virtue of the rotation of the barrier. This low placement provides the advantage for those who are caretakers for the child since adults can easily climb over the barrier 10.

As will be understood by comparison among FIGS. 1, 2A, 2B and 3A for example only, the barrier may have a cross-section of various shapes such as circular, polygonal, or even oval (not shown). The cross-sectional diameter should be sufficient for the intended purpose of the rotating member and, as a non-limiting example the barrier may have a diameter in the range of approximately 5 to 20 centimeters (2 to 8 inches).

Figure 2A:
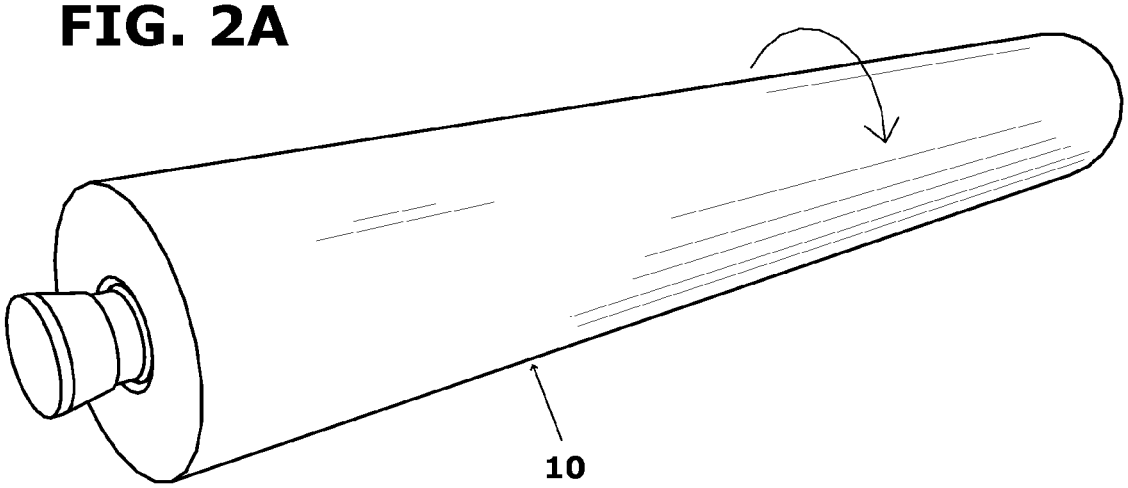
FIGS. 2A and 2B are perspective views of a rotating portion of a child safety barrier.
Figure 2B:
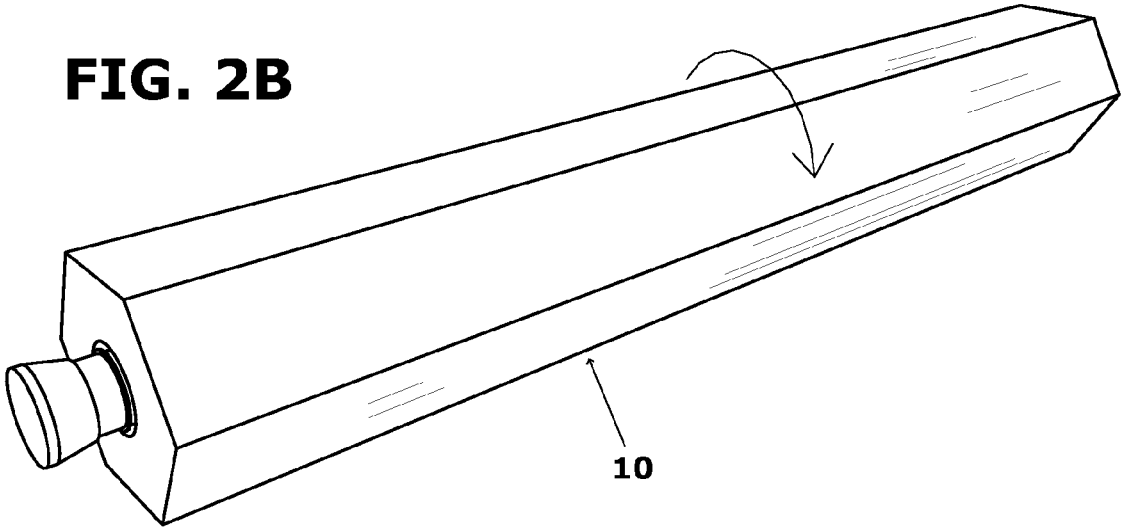
Figure 2C:
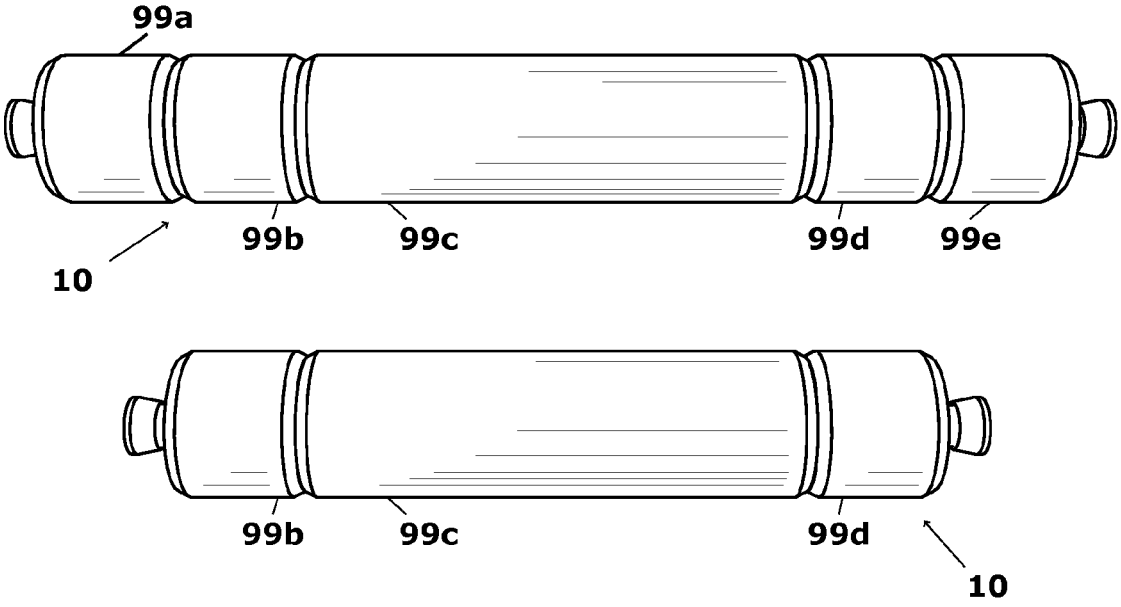
FIGS. 2C and 2D illustrate alternative embodiments of a rotating portion of the child safety barrier.
Figure 2D:
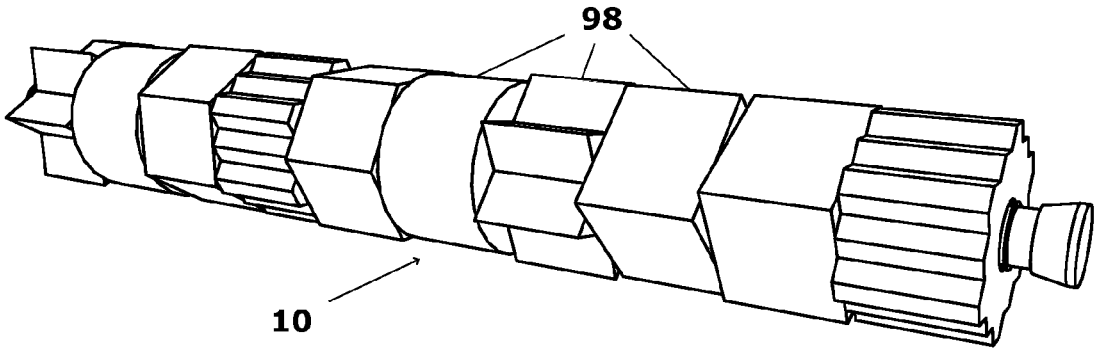

FIG. 3A provides an exploded perspective view of barrier 10 shown fully assembled in FIGS. 1 and 2A. The outer tubular part of the barrier, i.e. elongated member 14, is preferably made of a shock-absorbing material to reduce the likelihood of potential injury to the child. Polyurethane or foamed polystyrene are preferable because besides being axially resiliently compressible and shock-absorbing, they are also easy to trim so that their length can be adjusted to the width of the passageway. However, other materials, such as inflatable rubber tubes, may be equally suitable. The elongated member may be formed of polyurethane, foamed polystyrene, Styrofoam, rubber, paper, wood, metal, or combinations of two or more thereof. Further, the trimming of elongated member 14 can be made easier by adding several cross-sectional perforation lines 28 on the surface of elongated member 14 that can be used for tearing off excess length from elongated member 14 evenly along perforation lines 28 and without the need for a knife or scissors. The elongated member 14 can be made to have multiple sections. If the elongated member is made of multiple inflatable sections, the sections can be selectively inflated as necessary to achieve a desired length of elongated member 14. FIG. 2C illustrates multiple sections for the barrier 99*a*-99*e*. Additionally, FIG. 2D illustrates that elongated member 14 can be replaced with a plurality of barrier members 98, which need not be of the same cross-section, and which form a row. The length of this row can be regulated by varying the number of individual barrier members 98 on a support rod 16 with the support rod 16 being illustrated in FIG. 3A.

Referring again to FIG. 3A, an elongated member 16 is to be positioned within the lumen or hollow core 18 of the elongated member 14. Elongated member 16 may be referred to as a support rod, support arbor, support shaft or tension bar although other terms may be used to describe elongated member 16 and its function.

Considering FIGS. 1 and 3A together, it should be appreciated that the barrier 10 is to be positioned and retained between generally vertical uprights so that barrier 10 may serve its intended purpose across passageway 12. The elongated member 14 is positioned and retained such that a rotational movement may be achieved by the application of a slightest amount of external force, such as the force caused by the pressure of the hand of a small child. This will be described in greater detail below.

The support rod 16 can be made by forming the rod as first and second (or more) substantially cylindrical rod sections. This provides an option of allowing the length of the rod to be adjustable. Regardless of whether the adjustable feature is desired, if the rod is formed of first and second sections, the second rod section should be made hollow and should have an inner diameter slightly greater than the outer diameter of the first rod section. Accordingly, the first rod section can be telescopically received within the second rod section to a depth that causes support rod 16 to have the desired effective length. One rod section is then twisted relative to the other so as to lock support rod 16 in the obtained length. Optionally, one rod section may be force fit into the other rod section.

Each end of tension bar 16 can include a pressure surface 20, such as a non-slip portion which can be a rubber or non-slip plastic tip. The pressure surface is adapted to bear against the sides of passageway 12 when the barrier is in place to increase the frictional engagement of the barrier 10 across passageway 12 and reduce the possibility of damaging the upright surfaces engaged by support rod 16. Tension bars are well-known in the art and are often used in mounting shower and window curtains.

Figure 3B:
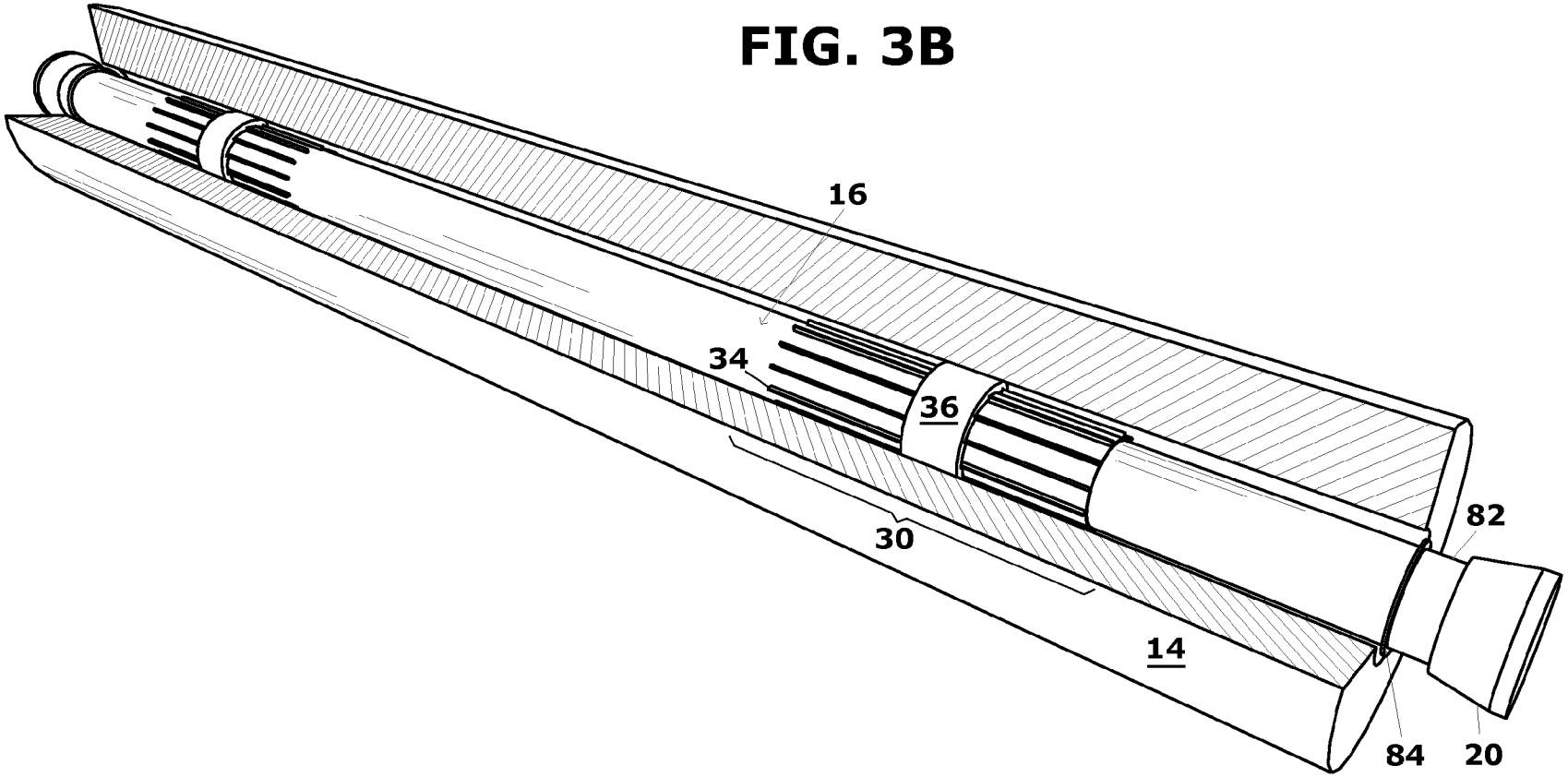
FIGS. 3B and 3C are perspective views, partially cut away, of a rotating portion of the child safety barrier.
Figure 3C:
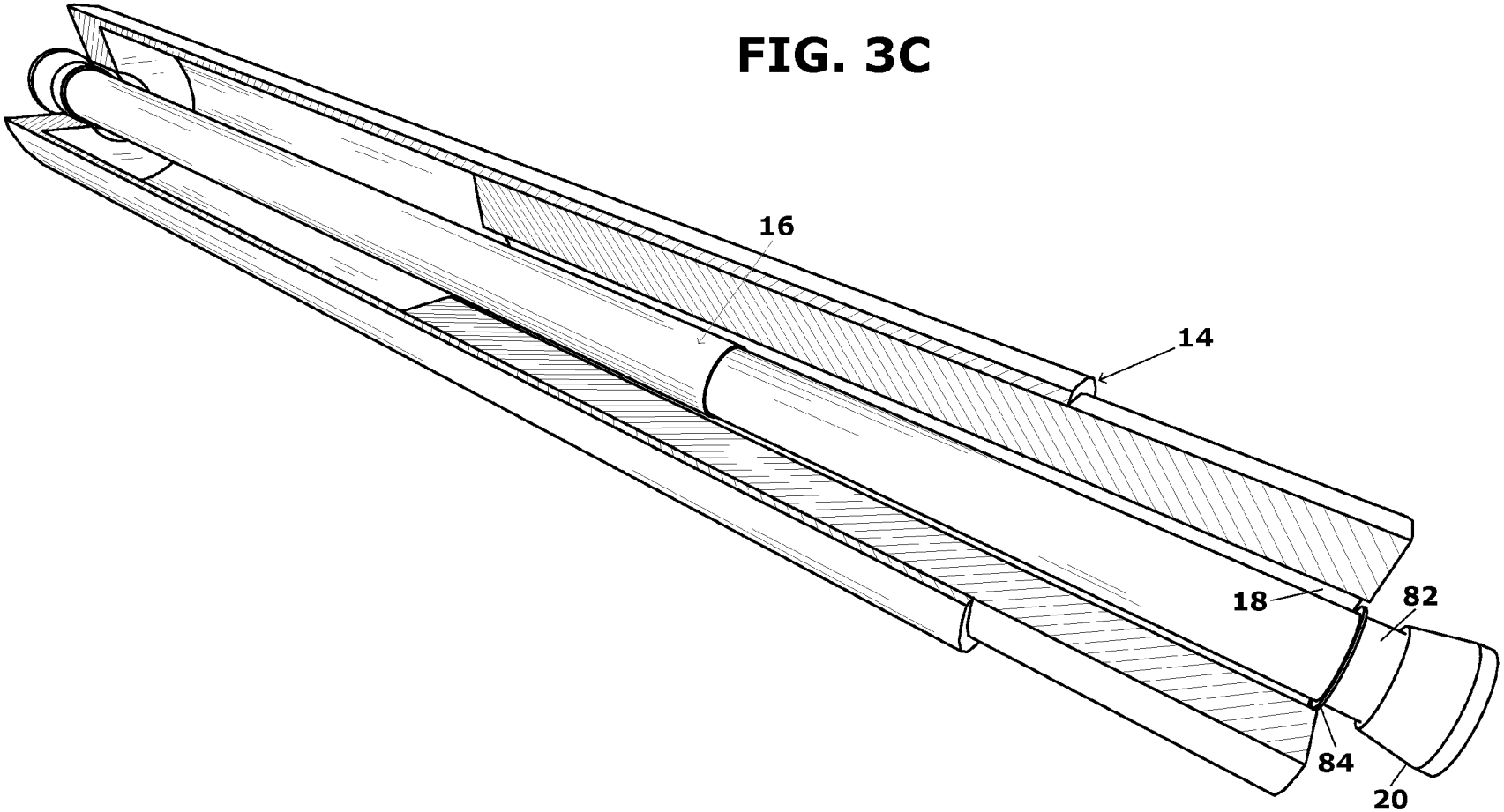

The length of elongated member 14 can be made adjustable by forming the elongated member from two (or more) telescopically extendable sections as generally illustrated in FIG. 3C. Once the desired length of elongated member 14 is achieved, the multiple sections can be either twist-locked together or secured to each other by some other means, such as adhesive tape, loop and eye fasteners, etc.

Means are provided to ensure that the elongated member 14 spins or rotates around support rod 16 only in one direction. One mechanism for achieving this objective is illustrated in FIG. 3B, where support rod 16 is illustrated as having a ratchet mechanism 30 formed from a plurality of generally parallel ratchet flanges or ratchet ribs 34. The flanges are circumferentially spaced apart and the flanges may also be longitudinally spaced apart. Ratchet mechanism 30 can provide an added measure of safety of barrier 10 in such a way as to permit the rotation of elongated member 14 only towards a child and never away from the child, thereby reducing the likelihood of the child being accidentally carried over to the opposite side of barrier 10.

Ratchet mechanism 30 may include a slanted-tooth sprocket, ratchet sprocket, or ratchet wheel 36, preferably affixed to the walls of lumen 18 of elongated member 14, and a plurality of ratchet flanges or pawl flanges 34. The teeth 38 of slanted-tooth sprocket 36 have a ramp slope at one edge and a steep abutment (e.g. 90°) at the opposite edge, so that the ratchet flanges 34 tend to slip when elongated member 14 is rotated in the releasing direction and jam against the steep abutment of teeth 38 when elongated member 14 is rotated in the locking direction. The teeth 38 are illustrated for example in FIG. 3D.

If the elongated member 14 is formed of a pliable or flexible material, or utilized with a rod 16 having one or two spring loaded ends (i.e., a tension rod) the barrier may be installed between uprights by compressing one (or both) ends of the elongated member 14 axially inwardly. This will expose the support rod 16 such that the support rod may be positioned within the vertical uprights (e.g., a door jab). The length of the support rod is next adjusted and the ends of support rod 16 are positioned against the sides of the installation site, such as passageway 12—the adjustment of the length is such as to provide sufficient tension for secure mounting. The two rod sections are twisted relative to each other (one or both may be twisted) to lock the two rod sections at the desired length. Then the ends of elongated member are released such that they substantially cover support rod 16 within.

The barrier should be positioned horizontally or at least substantially horizontally between the vertical portions of the passageway.

As an alternative, the rod 16 may be made of a fixed length commensurate with the width of a crib or a standard interior house door opening.

Figure 3D:
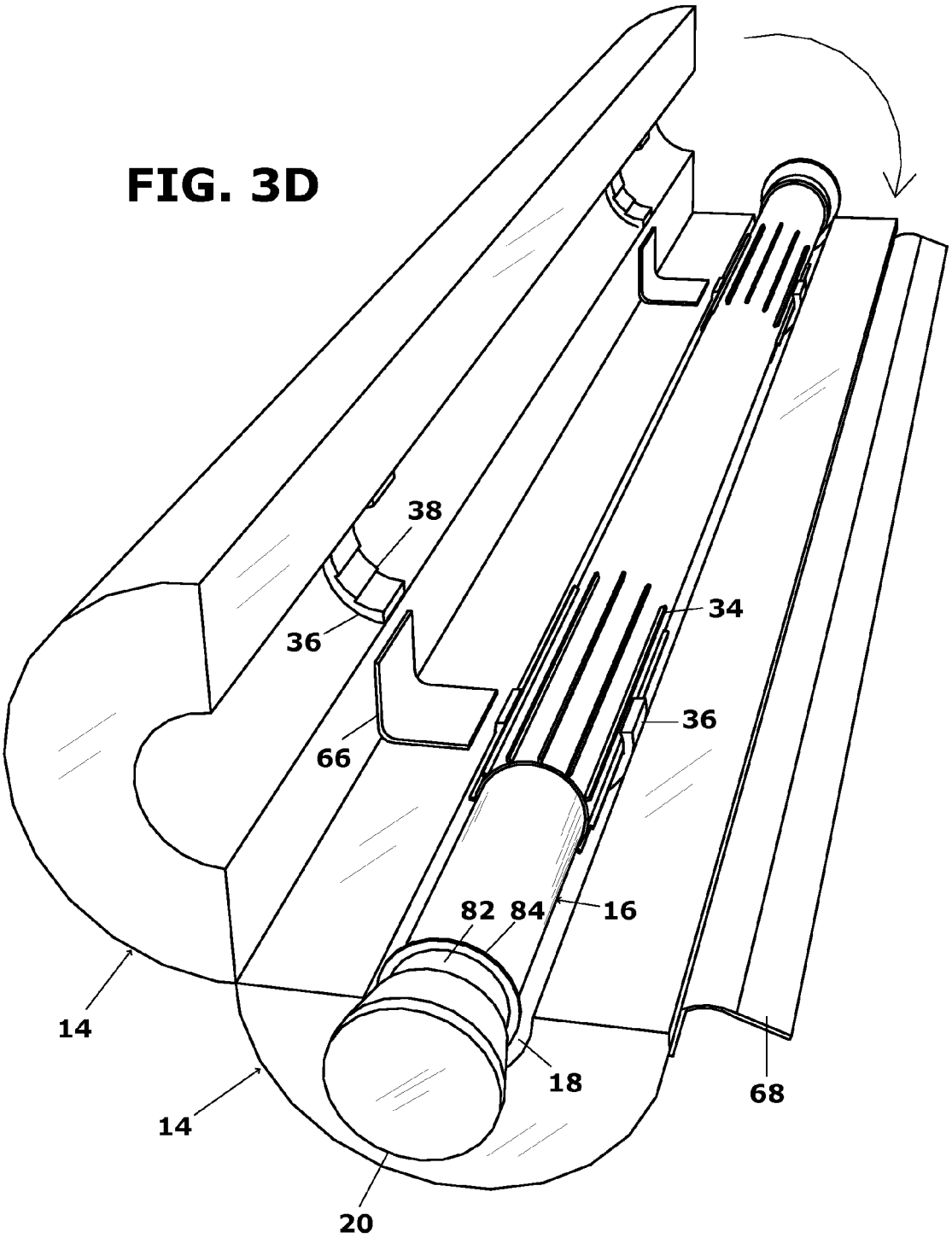
FIG. 3D is a perspective view of an alternate embodiment of a rotating portion of the child safety barrier.

As another alternative, as illustrated in FIG. 3D, if elongated member 14 is made of a less pliable or retractable material, such as Styrofoam, elongated member 14 can be fabricated in such a way that it can be placed over support rod 16 after support rod 16 has already been securely positioned against the sides of passageway 12. This can be achieved by, for example, fabricating elongated member 14 to have two (or more) longitudinally separable portions which may be held together by one or more longitudinally spaced apart hinges 66 and sealed via adhesive tape or loop and eye fasteners 68 or other suitable attachment mechanisms.

In the alternative described in the preceding paragraph, the sprocket 36 must be formed of multiple parts that make up a single unit when the two parts of elongated member 14 are brought together.

Figure 4A:
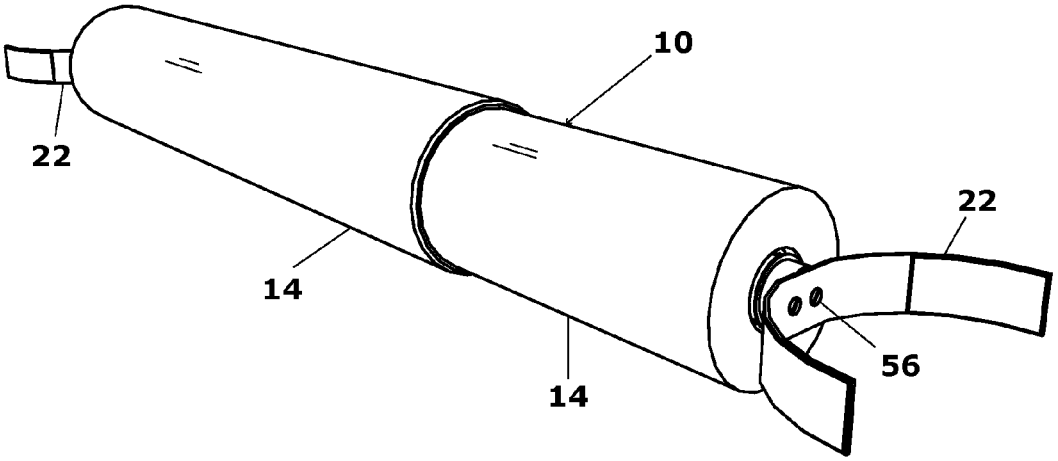
FIGS. 4A and 4B are perspective views of other embodiments of the child barrier.
Figure 4B:
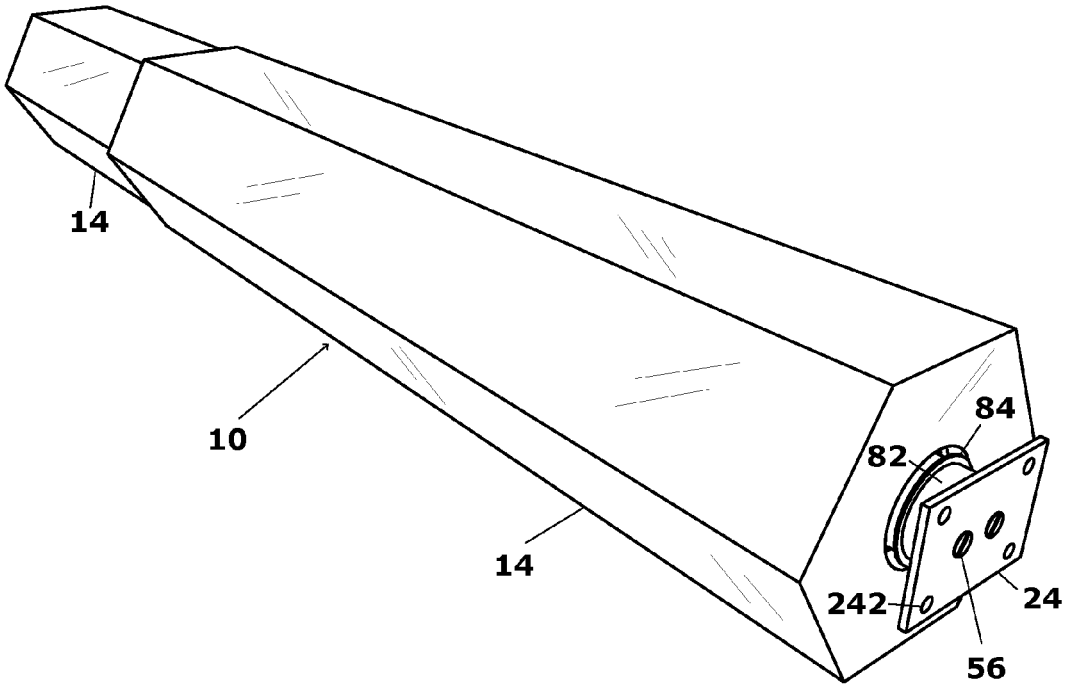
Figure 5A:
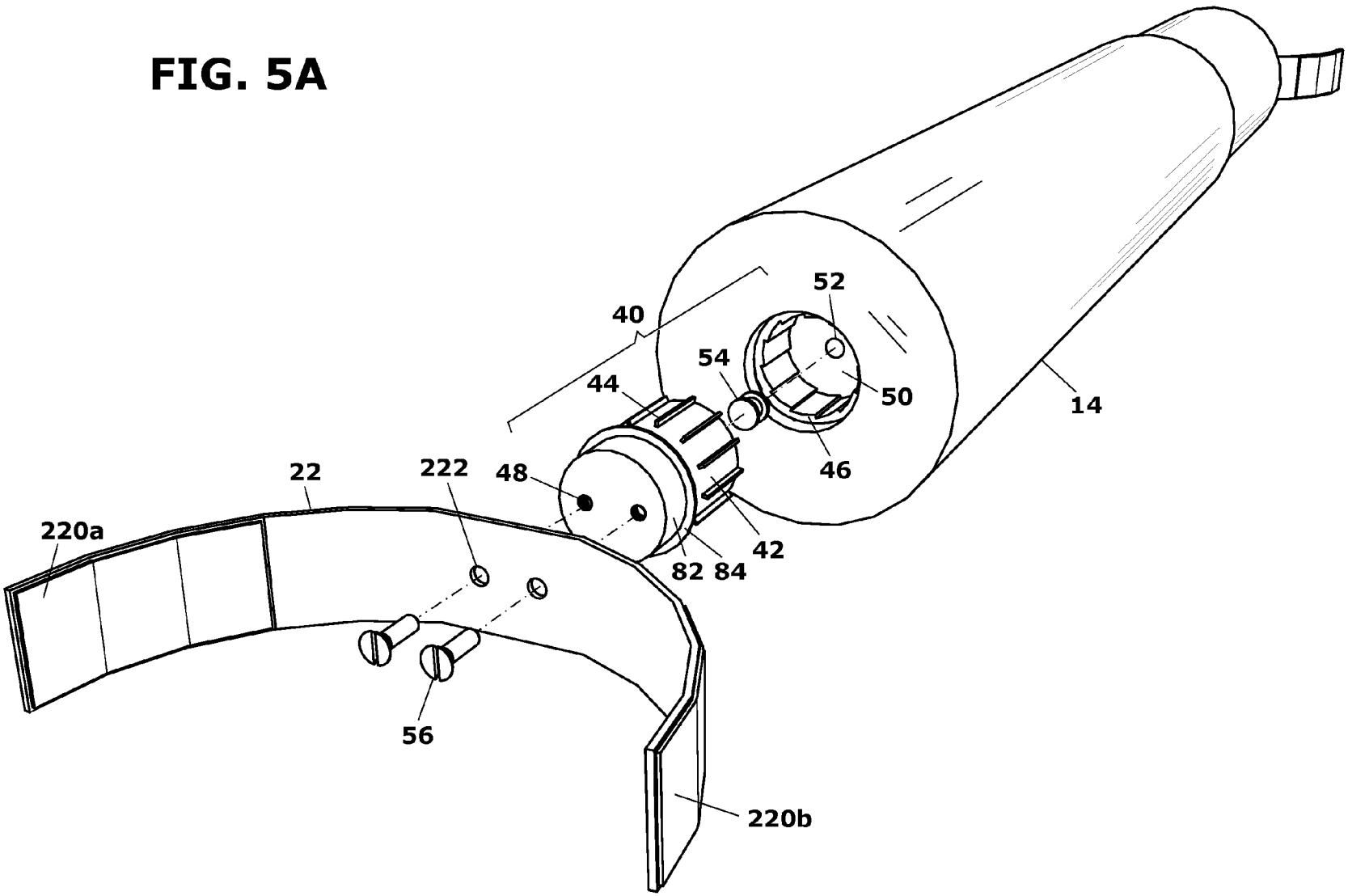
FIGS. 5A, 5B, and 5C are exploded perspective views of portions of the child safety barrier.
Figure 5B:
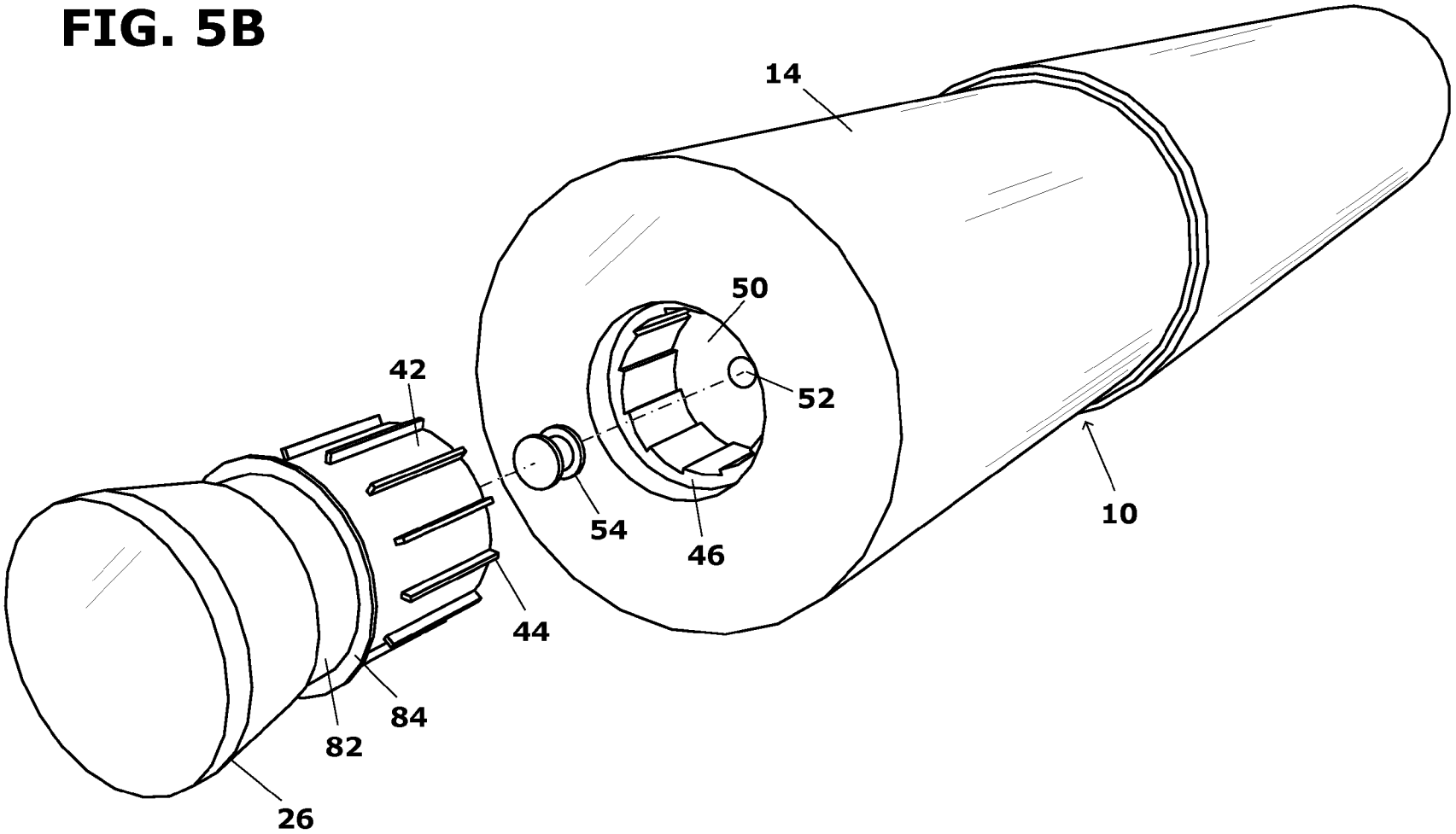
Figure 5C:
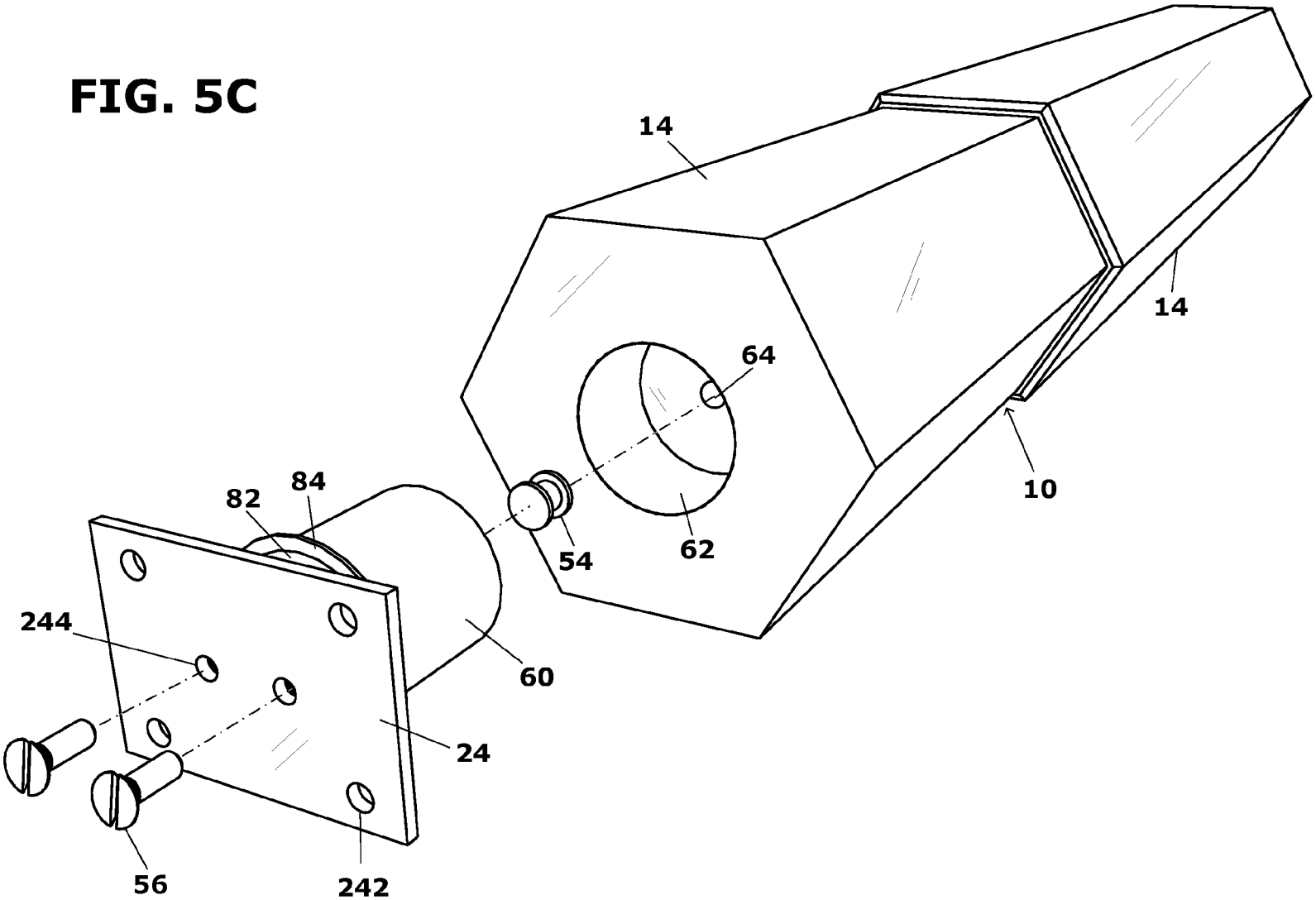

The barrier 10 does not require an internal support rod 16. FIGS. 4A, 4B, 5A, 5B, and 5C illustrate barriers 10 with alternative means for suspending the elongated member 14 between vertical posts. As an overview, FIG. 4A illustrates a generally "C" shaped attachment member 22, FIG. 4B illustrates a mounting plate 24, FIG. 5A illustrates additional details of the attachment member 22, FIG. 5B illustrates non-slip ends 26 for the barrier, and FIG. 5C illustrates additional details of the mounting plate 24. It should be appreciated that the details are illustrated for only one end of the barrier.

The effective length of the barrier 10 shown in FIGS. 4A through 5C can be altered by fabricating elongated member 14 to include first and second tubular sections, which can have various cross-sectional shapes as previously noted, with the second tubular section being hollow and should be suitably sized such that the first tubular section can be telescopically received within the second tubular section (as shown in FIG. 4A) to a depth that causes elongated member 14 to have the desired predetermined effective length. It is not required that the two sections of elongated member 14 have a twistable locking mechanism, i.e. they can be engaged with one another in a freely sliding way, if the ends of barrier 10 are provided with bands 22 or plates 24. However, if the ends of the barrier 10 are provided with drum ends 26, then it is preferred that the two tubular sections can lockably engage with one another in order to provide sufficient tension on both ends of the barrier such that the barrier is maintained in the desired position.

It should be appreciated that the various attachment mechanisms are illustrative and non-limiting in nature. The proposed location of the barrier may result in one attachment mechanism be preferred over other attachment mechanisms. For illustrative, non-limiting purposes only, it should be appreciated that safety barrier installation sites, such as a hallway, stair landing, corridor, entrance to a room or other household area, may make one type of barrier end more suitable than another. Thus, for example, mounting plates 24 may be preferred for a more permanent installation of barrier 10 against flat walls or doorposts, while bands 22 may be preferred for maintaining barrier 10 across the balustrades or newel posts of a staircase.

FIGS. 5A, 5B, and 5C provide further details on the potential constructions of the embodiments described immediately above. In the embodiments of FIGS. 5A and 5B, at least one end of a variable-length elongated member 14 may have a circular ratchet recess 50 if barrier 10 includes a unidirectional-rotation ratchet mechanism 40 as shown in FIGS. 5A and 5B. Thus, in FIGS. 5A and 5B, a ratchet recess 50 is provided with a slanted-tooth sprocket 46. The back wall of each recess 50 has a recess aperture 52 so that the ratchet drum 42 may be attached to the elongated member 14 via a double headed rivet or pin 54. The rivet or pin 54 is preferably of a dimension to allow free rotational movement of the drum 42 in relation to elongated member 14 in one (or both) directions depending upon the presence (or absence) of ratchet mechanism, respectively. Ratchet drum 42 may be further attached to via a C-shaped member 22 having double sided adhesive ends and/or loop and eye fasteners 220*a*, 220*b* which may be used to attach the barrier across the passageway. Bolts 56 are provided which extend through apertures 222 in the C-shaped member 22 and are received by threaded apertures 48 in the drum 42. A series of axially extending circumferentially spaced apart ratchet teeth 44 may be provided on the drum 42.

As another attachment option, a smooth drum 60 may be fitted within an aperture 62 in the elongated member, again through the use of a rivet 54 with one end of the rivet received within an axial aperture 64 in the elongated member. In the embodiment of FIG. 5C, the bolts 56 extend through apertures 244 in a generally flat attachment plate 24 with the bolts being threaded through apertures in the plate. Attachment plate 24 may have apertures 242 for installing barrier 10 within passageway 12 or crib 13 (described below) with bolts, screws, nails or any other suitable fastener.

The embodiments of barrier 10 depicted in FIGS. 4A through 5A and FIG. 5C, can be installed by simply positioning barrier 10 across passageway 12 at a desired height off the floor and attaching each end of barrier 10 to the sides of passageway 12. The embodiment shown in FIG. 5B is installed by placing barrier 10 in the desired position across passageway 12, extending its length enough to have sufficient tension across passageway 12, and locking the two tubular sections of elongated member 14 in order to maintain the length of the elongated member 14 and thus maintain the necessary tension.

Figure 6A:
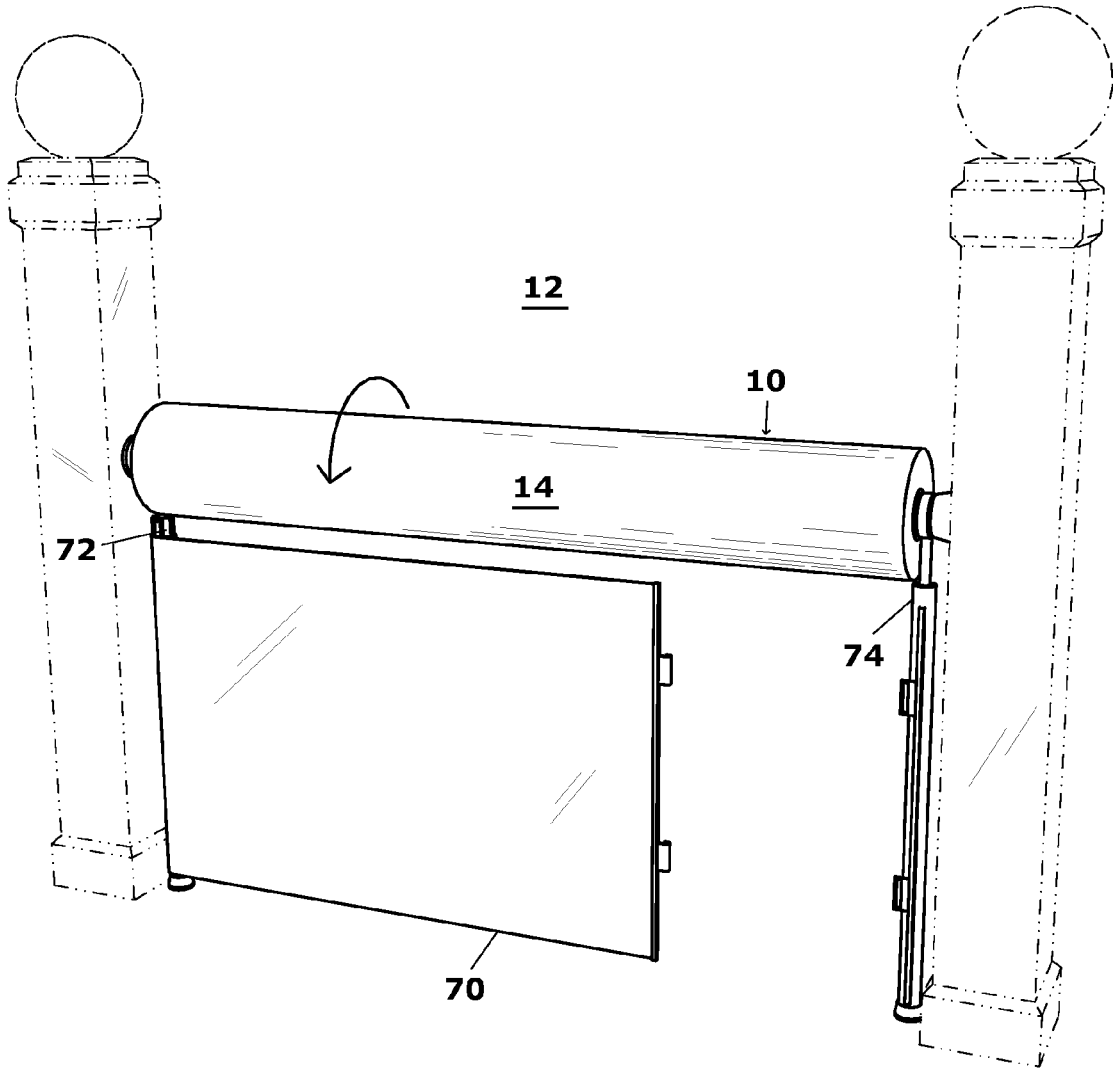
FIGS. 6A and 6B are perspective views of other embodiments of the child safety barrier.

FIG. 6A illustrates an alternate embodiment of barrier 10 where the barrier is disposed higher up off the floor than the embodiments shown in the previous figures. The embodiment of FIG. 6A includes one or more blocking members disposed vertically below barrier 10. A solid (or web or screen) blocking member is illustrated in FIG. 6A, and may be considered a blocking member, a partitioning membrane or partitioning screen 70. The purpose of blocking member 70 is to have the rotatable barrier 10 a sufficient height off the floor so as to limit the ability of a larger child to move through the passageway 12. However if the barrier 10 were placed a sufficient height above the floor to limit the ability of a large child to climb over the barrier, there would be a larger vertical gap below the barrier through which the child could crawl. Thus blocking member 70 assists in preventing the child from moving through the passageway. It may be appreciated, for example, that it would be preferred to have the center of the barrier 10 at approximately shoulder height of a larger child. The use of blocking member with the barrier at a sufficient height above the floor also provides a benefit in limiting access through the passageway of animals that might otherwise be able to jump over a lower-placed barrier. As a child grows taller, the embodiment of FIG. 1 may be replaced with the embodiment of FIG. 6A.

Figure 6B:
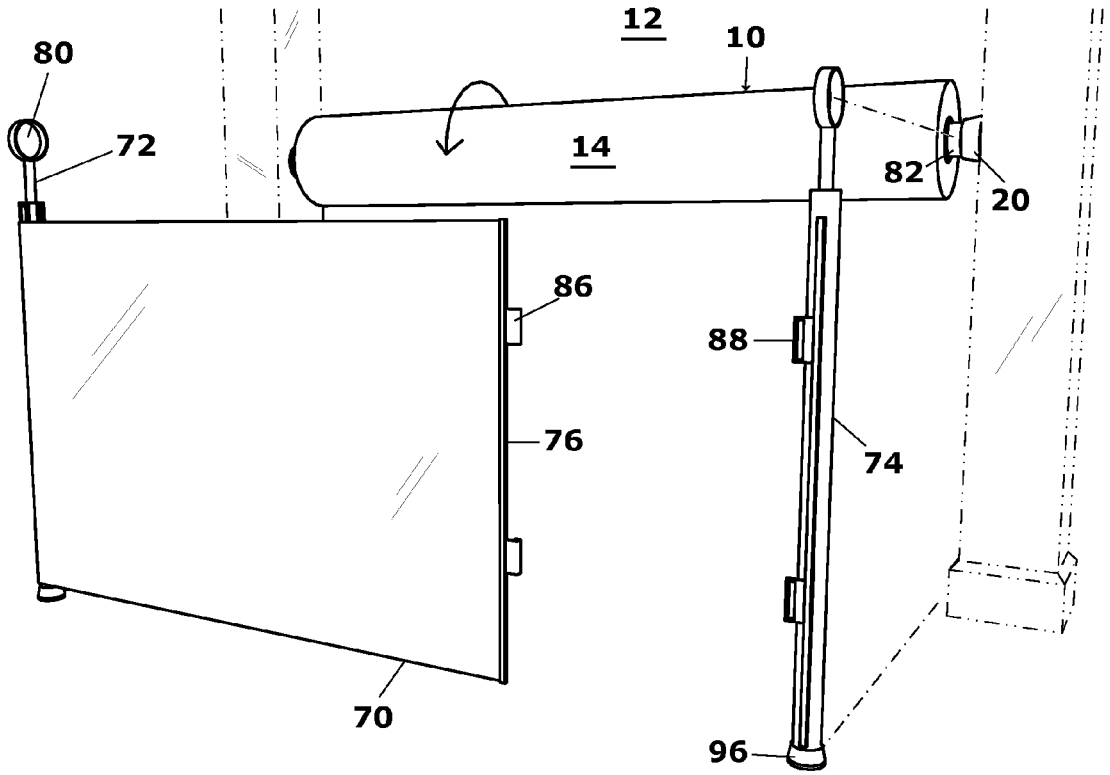

FIGS. 6A and 6B illustrate further details of a blocking member and its attachment and use. The blocking member 70 is positioned to extend between two vertically spaced apart supports 72, 74. Each of supports 72, 74 includes an upwardly extending post terminating in an aperture 80, 82 respectively, through which elongated rod 16 (or the mounting devices as heretofore described) extend. As understood by those of skill in the art, the supports 72, 74 may be made of suitable material. Supports 72 and 74 may each include a non-slip support shoe 96 for a better grip on the surface of the floor.

Figure 7A:
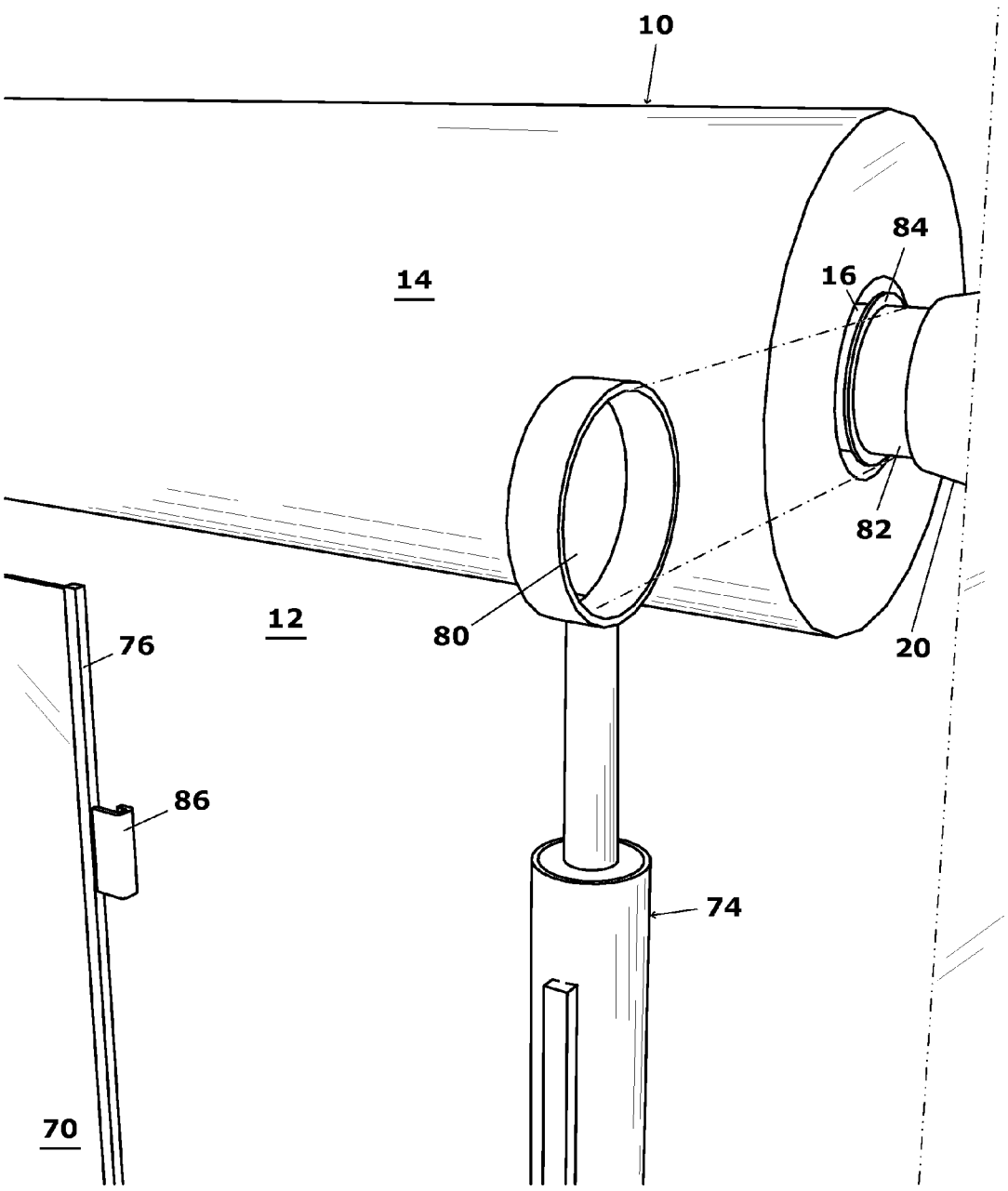
FIGS. 7A, 7B, 7C, and 7D are enlarged illustrative views of portions of the child safety barrier of FIGS. 6A and 6B.

Various parts of the embodiments depicted in FIGS. 6A and 6B are illustrated in an enlarged form in FIGS. 7A-7D for ease of understanding. FIG. 7A illustrates foramens 80 at the top of each of membrane supports 72 and 74. (A foramen in the generic sense is an opening within a solid object.) Support rod 16 (or the mounting systems illustrated, for example, in FIGS. 5A and 5B) includes foramen grooves 82 and the foramens 80 fit onto these foramen grooves. Radially outwardly extending foramen groove fences or ridges 84 extend around the periphery of the rod to limit axial movement of the foramens 80 and thus provide additional structural stability to the barrier. Thus depending upon the mounting system used, the ratchet drum 42 and smooth drum 60 can also be fabricated to have foramen grooves 82 and foramen groove fences 84. To install the rod through the foramens, the non-slip rod ends 20 and non-slip drum ends 26 can be temporarily detached in order to slide membrane support foramens 80 onto foramen grooves 82. For the same reason, loop and eye or hook and eye bands 22 and mounting plates 24 can be detached (e.g. unscrewed) from ratchet drum 42 or smooth drum 60.

Figure 7B:
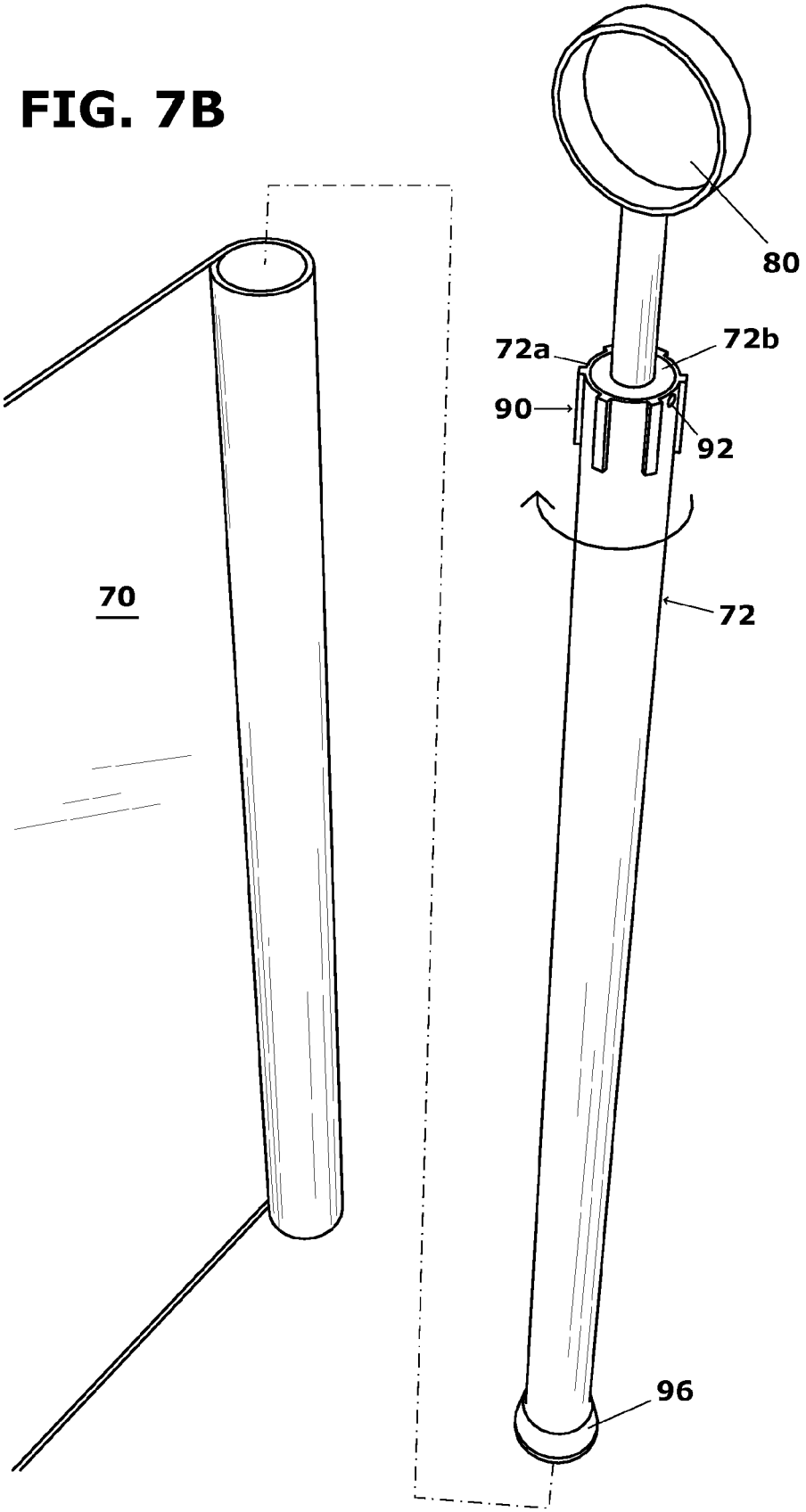
Figure 7C:
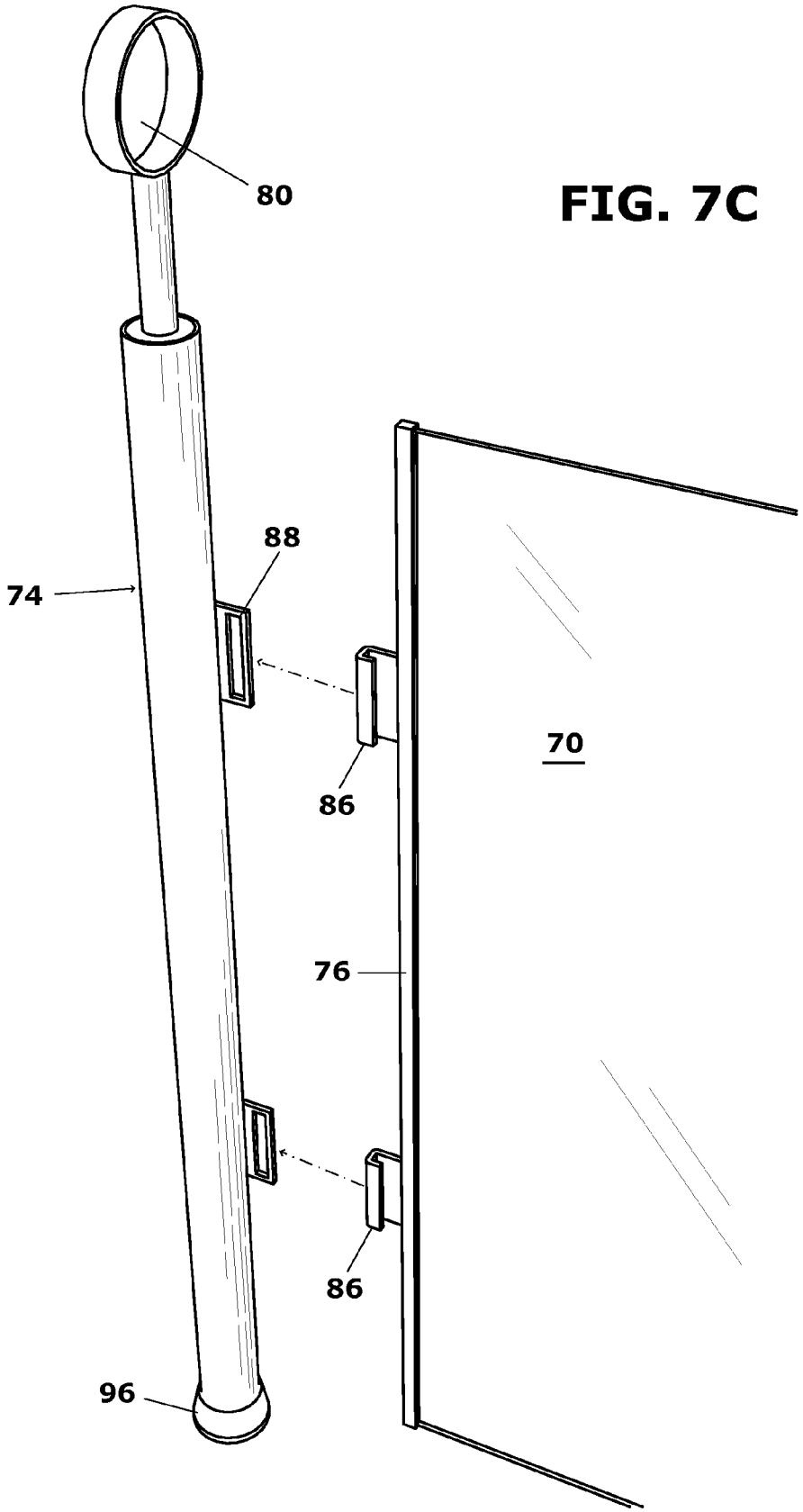
Figure 7D:
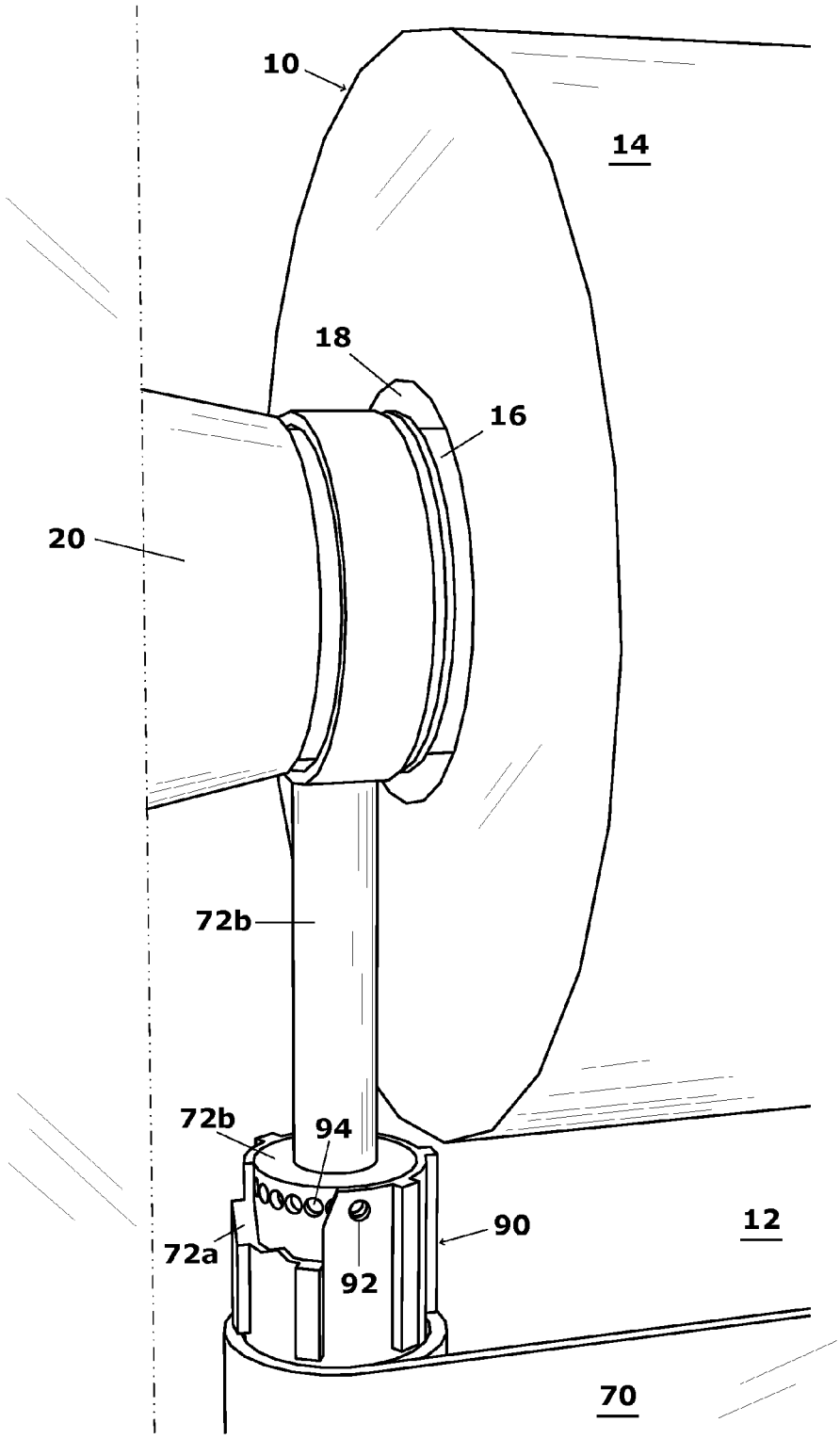

As illustrated in greater detail in FIGS. 7B and 7D, membrane support 72 may be formed as a hollow outer tube 72*a* fitted over an inner shank 72*b* and dimensioned to allow free rotation of tube 72*a* around shank or shaft 72*b* but with the inner diameter of tube 72*a* being sufficiently close to the outer diameter of shaft 72*b* so that there is suitable rigidity of the assembly. One end of partitioning membrane 70 is permanently attached to outer tube 72*a* of membrane support 72 and can be rolled onto outer tube 72*a* for retraction. The membrane 70 may include a vertical edge or pull bar 76 at the end of the membrane or blocking member 70 such that the edge may be gripped to extend the blocking member outwardly from tube 72*a*. The pull bar or edge 76 may be provided with at least one laterally outwardly extending hook 86 which can be fastened to locking slits 88 formed in the opposite tube 74. For ease of illustration, two such hooks and slits are illustrated in FIG. 7C.

Generally, it is preferred to provide sufficient tension across the blocking member 70 so as to provide a relatively solid blocking effect, i.e., a blocking which is not easily overcome by a child or small animal attempting to move through the passageway. The degree of tension may optionally be made adjustable and, for this purpose an optional tension wheel 90 is provided at the base of vertical support 72. As illustrated in detail in FIG. 7D, tension wheel or reeling wheel 90 has an aperture 92. Inner shank 72*b* is provided with a series of circumferentially spaced apart apertures 94 adjacent its upper end. In operation, the tension in the fully extended partitioning membrane 70 is increased by rotating the reeling wheel 90 located at the top of outer tube 72*a*, thereby rotating outer tube 72*a* itself, in the tightening direction (clockwise in the drawings). Wheel 90 is rotated to increase (or decrease) tension and a conventional locking pin (not shown) is inserted through aperture 92 and one of the apertures 94 which is aligned with aperture 92 at the desired degree of tension, thereby locking the position of outer tube 72*a* in relation to shank 72*b* at the desired level of tension of partitioning membrane 70.

Figure 8:
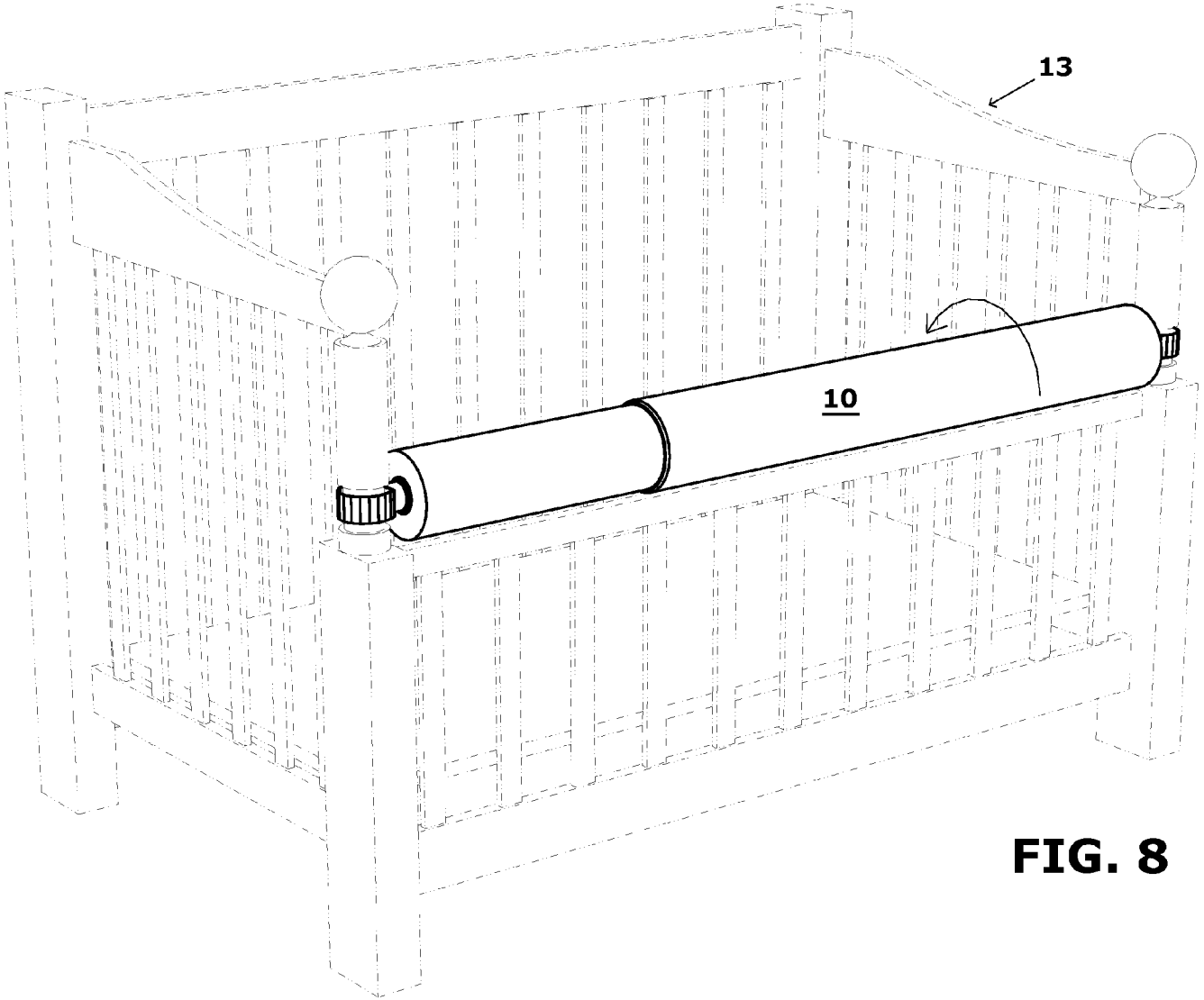
FIG. 8 is a perspective view of a child safety barrier mounted to a crib.

A barrier 10 may be utilized to assist in restraining a child within a crib, play pen, play area or the like. For ease of understanding, the barrier is illustrated as being installed adjacent to (e.g. just above) a horizontal rim of a crib 13. It is preferable that barrier 10 is installed on one of the two longer sides of crib 13. It is also preferable that the barrier installed on a crib or the like include a ratchet mechanism 30 that allows elongated member 10 to spin or rotate only towards the inside of crib 13, i.e. only in the direction of the arrow on the drawing, in order to further reduce the likelihood of the child falling or climbing out of the crib. In the embodiment of FIG. 8, the barrier is horizontal, i.e., parallel to the horizontal rim of the crib although it must be appreciated that the barrier need not be exactly horizontal in any of the embodiments.

Figure 9:
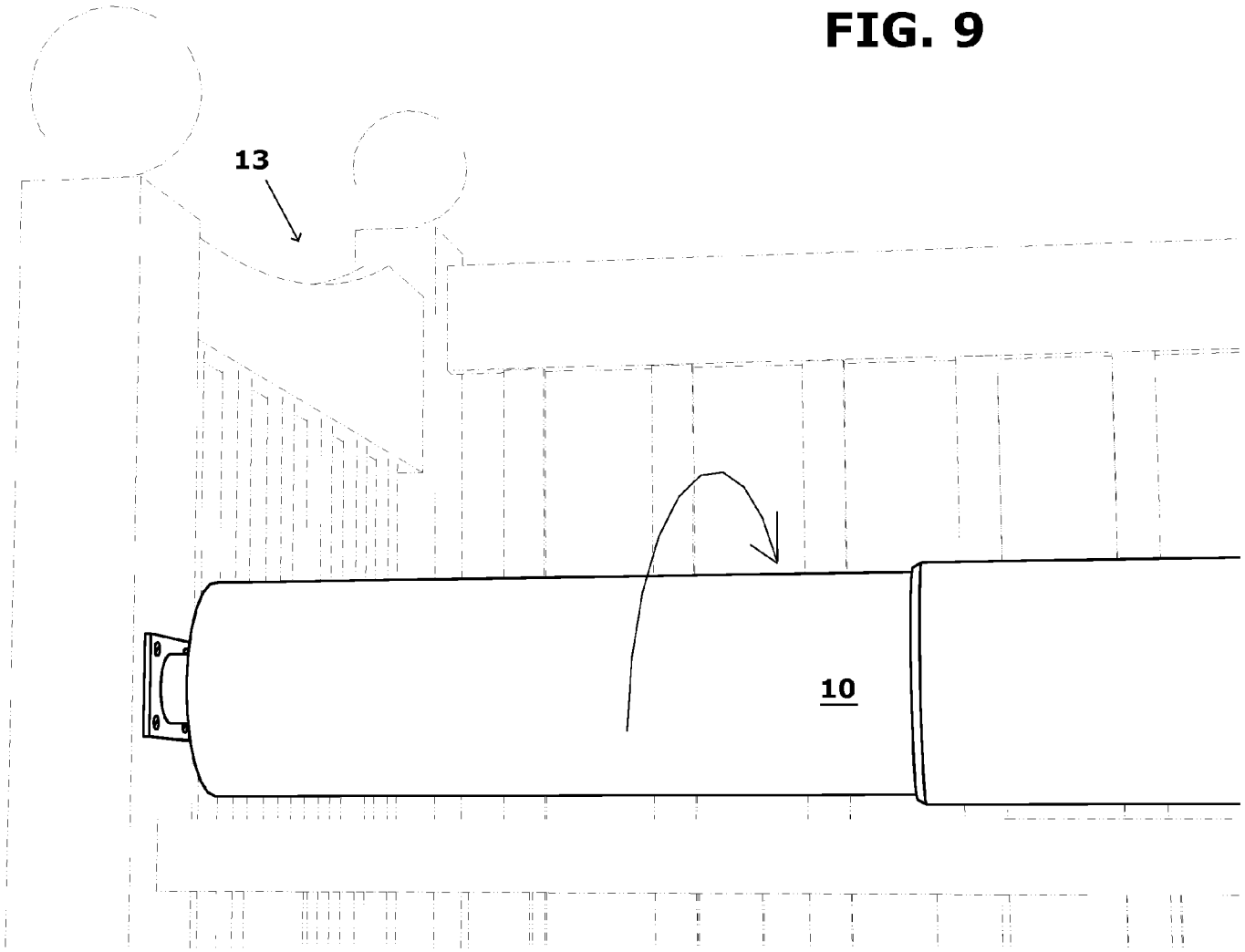
FIG. 9 is a partial perspective view of a child safety barrier mounted to a crib.

It should be appreciated that barrier 10 may be installed upon cribs, play pens, enclosed play areas or the like by means of various attachment mechanisms. An example of a method of attaching barrier 10 to crib 13 is also illustrated in FIG. 9 wherein mounting plates 24 are attached to the vertical upright portion of the crib. Only one mounting plate is illustrated. The use of the mounting plate is further explained in the context of FIG. 4B. Again, neither FIG. 8 nor FIG. 9 should be interpreted as limiting in nature.

The foregoing is a complete description of various embodiments of the barrier. The foregoing description, however, should be interpreted as illustrative and non-limiting, i.e., the foregoing exemplifies several non-limiting embodiments. Accordingly, the scope of the present invention should not be limited by the embodiments but only by the appended claims and such equivalent as are applicable under the law.

What is claimed is:

1. A child safety barrier system to prevent passage through a passageway, said barrier system comprising an elongated member, said elongated member is mounted horizontally onto an upper portion of at least one of a crib, a playpen or a play yard, means for supporting said elongated member approximately horizontally relative to said passageway, said supporting means positioned inside of and permitting rotation of said elongated member relative to said supporting means, and said elongate member comprising a ratchet sprocket to restrict rotation of said elongated member in a single direction, said ratchet sprocket circumferentially surrounding a plurality of pawl flanges, said plurality of pawl flanges mounted onto said supporting means.

2. The child safety barrier system according to claim 1, wherein said passageway is a doorway and further including means to attach said supporting means to said doorway.

3. The child safety barrier system according to claim 2, wherein said supporting means is removably attached to said doorway.

4. The child safety barrier system according to claim 1, wherein said passageway is defined by at least one of a vertical and horizontal portions of the crib.

5. The child safety barrier system according to claim 1, wherein said elongated member is supported in an axial direction by said supporting means.

6. The child safety barrier system according to claim 1, wherein said elongated member is of a substantially circular cross-section.

7. The child safety barrier system according to claim 1, wherein said elongated member includes first and second sections.

8. The child safety barrier system according to claim 1, wherein said elongated member includes first and second sections, one of said first and second sections being at least partially longitudinally received in the other of said first and second sections.

9. The child safety barrier system according to claim 1, wherein said elongated member includes a lumen and wherein said supporting means includes at least two sections, one of said sections at least partially received within the other of said two sections, said two sections being longitudinally lockably adjusted to a desired length.

10. The child safety barrier system according to claim 1, wherein said elongated member is made of a material selected from the group consisting of polyurethane, foamed polystyrene, Styrofoam, rubber, paper, wood, and combinations of two or more thereof.

11. The child safety barrier system according to claim 1, wherein said elongated member is formed of an axially resiliently compressible material.

12. The child safety barrier system according to claim 1, wherein said elongated member is longitudinally openable.

13. The child safety barrier system according to claim 1, wherein said elongated member is supported above a generally horizontal surface to create a vertical space therebetween, and further including means for obstructing said vertical space.

14. The child safety barrier system according to claim 13, wherein said obstructing means extends substantially along the length of the elongated member.

15. The child safety barrier system according to claim 14, wherein said obstructing means is one of (a) a vertical crib side, (b) a generally rigid member, or (c) a flexible member.

16. The child safety barrier system according to claim 15, wherein said obstructing means is adjustable in at least one of the horizontal and vertical directions.

17. A child safety barrier system comprising:

a plurality of barrier members, each of said members having a respective lumen;

a support rod, said support rod at least partially positioned within said respective lumen of said barrier members, said barrier members are mounted horizontally onto an upper portion of at least one of a crib, a playpen and a play yard, and at least one of said barrier members including a ratchet sprocket, and said support rod including a plurality of pawl flanges, said ratchet sprocket circumferentially surrounding said pawl flanges to restrict rotation of at least one of said barrier members in a single direction, and means for mounting said barrier members axially relative to each other;

whereby said barrier members form a substantially horizontal row.

18. A child safety barrier system according to claim 17 wherein said mounting means allows rotation of said barrier members relative to said support rod.

* * * * *